US010889986B1

(12) United States Patent
Freehauf

(10) Patent No.: US 10,889,986 B1
(45) Date of Patent: Jan. 12, 2021

(54) CUPOLA BODY FABRICATED FROM EXTRUSIONS

(71) Applicant: Plyco Corporation, Elkhart Lake, WI (US)

(72) Inventor: Timothy E. Freehauf, Walkerton, IN (US)

(73) Assignee: PLYCO CORPORATION, Elkhart Lake, WI (US)

( * ) Notice: Subject to any disclaimer, the term of this patent is extended or adjusted under 35 U.S.C. 154(b) by 0 days.

(21) Appl. No.: 16/558,641

(22) Filed: Sep. 3, 2019

(51) Int. Cl.
*E04B 7/18* (2006.01)
*E04C 3/04* (2006.01)

(52) U.S. Cl.
CPC ..... *E04B 7/18* (2013.01); *E04C 3/04* (2013.01); *E04C 2003/0443* (2013.01)

(58) Field of Classification Search
CPC ..... E04B 7/18; E04B 1/0046; E04B 2/7107; E04B 2002/7487; E04B 2/96; E04C 3/04; E04C 2003/046; E04C 2003/0443; E04D 3/08; E04D 13/03; E04D 13/031; E04D 13/0305; E04D 13/032; E04D 13/0325; E04D 13/02; E06B 1/366; E06B 1/363; E06B 1/38
USPC ..... 52/200, 204.53, 213, 222, 235, 282.2, 52/765, 769, 773, 775
See application file for complete search history.

(56) References Cited

U.S. PATENT DOCUMENTS 1,220,219 A * 3/1917 Goldman ..... E04D 13/03 52/200
2,737,876 A * 3/1956 Smith ..... F24F 7/02 454/368
3,222,841 A * 12/1965 Lipof ..... E04B 1/5831 52/482
3,766,698 A * 10/1973 Dallen ..... E04B 2/96 52/204.597
4,050,201 A * 9/1977 Hubbard ..... E06B 3/9636 52/97
4,261,144 A * 4/1981 Rizzo ..... E04B 2/7433 160/392
4,601,139 A * 7/1986 Esposito ..... A01G 9/14 52/93.1
4,745,723 A * 5/1988 Esposito ..... E04D 3/08 52/461
4,884,376 A * 12/1989 DeBlock ..... E04B 1/0046 52/92.2
4,888,923 A * 12/1989 Post, Jr. ..... E04F 17/026 52/200

(Continued)

*Primary Examiner* — Theodore V Adamos
(74) *Attorney, Agent, or Firm* — Donald J. Ersler

(57) ABSTRACT

A cupola body fabricated from extrusions preferably includes a bottom frame, a first top frame, a second top frame and eight side rails. The bottom frame includes four bottom rails attached to each other with bottom fasteners. The first top frame includes four first top rails attached to each other with top fasteners. The second top frame includes four second top rails attached to each other with the top fasteners. A bottom of the eight side rails are attached to the bottom frame with side fasteners and a top of the eight side rails are attached to the second top frame with the side fasteners. The four bottom rails include a bottom glazing channel. The eight side rails include a side glazing channel. The four second top rails include a top glazing channel. The glazing channels are sized to receive four glazing panels.

15 Claims, 10 Drawing Sheets

(56) References Cited

U.S. PATENT DOCUMENTS 5,092,087 A * 3/1992 Kane ..... E04D 3/06 52/14
5,402,613 A * 4/1995 Giumenta ..... E04F 17/026 454/12
5,408,795 A * 4/1995 Eljadi ..... F24S 23/00 52/173.3
5,544,455 A * 8/1996 DeBlock ..... E04B 9/32 52/200
5,893,244 A * 4/1999 Magoon ..... E04B 2/965 52/235
5,906,078 A * 5/1999 Cramer ..... E04H 15/646 135/121
6,006,489 A * 12/1999 Zadok ..... E04B 1/0046 52/204.53
6,112,493 A * 9/2000 Rickman ..... E04B 1/0046 52/461
6,192,643 B1 * 2/2001 Zadok ..... E04B 1/0046 52/204.1
6,250,025 B1 * 6/2001 Darby ..... E04H 13/006 52/137
6,338,226 B1 * 1/2002 Gauthier ..... A01G 9/14 52/63
6,378,253 B1 * 4/2002 Richardson ..... E04B 1/0046 52/204.5
6,389,770 B1 * 5/2002 Santavicca ..... E04B 1/0046 52/13
6,668,495 B1 * 12/2003 Prince ..... E04C 3/06 160/391
7,017,307 B2 * 3/2006 Jones ..... E04B 7/063 52/200
2004/0031220 A1 * 2/2004 Hocker ..... E04B 2/965 52/235
2004/0074174 A1 * 4/2004 Biebuyck ..... E04B 2/96 52/235
2006/0242918 A1 * 11/2006 Richardson ..... E04D 3/08 52/200
2007/0107326 A1 * 5/2007 Uffner ..... E04B 7/028 52/200
2008/0148684 A1 * 6/2008 Bruder ..... F16B 5/0692 52/764
2014/0220288 A1 * 8/2014 Stabrawa ..... A47B 47/0008 428/57

* cited by examiner

CUPOLA BODY FABRICATED FROM EXTRUSIONS

BACKGROUND OF THE INVENTION

1. Field of the Invention

The present invention relates generally to roof accessories and more specifically to a cupola body fabricated from extrusions, which utilizes extruded aluminum rails fastened to each other to create the cupola body.

2. Discussion of the Prior Art

It appears that the prior art only discloses cupolas constructed from sheet metal and wood, or plastic. The sheet metal is not easily cut to make special sizes at a job site. The sheet metal usually requires the use of wood to reinforce the cupola sheet metal structure. Cupolas constructed from plastic will eventually dry out over time and crack.

Accordingly, there is a clearly felt need in the art for a cupola body fabricated from extrusions, which utilizes extruded aluminum rails fastened to each other to create a cupola body, which is more rigid than that the prior art; which may be easily assembled to different sizes; and which allows for quick installation of a cupola cover.

SUMMARY OF THE INVENTION

The present invention provides a cupola fabricated from extrusions, which utilizes extruded aluminum rails fastened to each other to create the cupola body. The cupola body fabricated from extrusions (cupola body) preferably includes a bottom frame, a first top frame, a second top frame and eight side rails. The bottom frame includes four bottom rails and a plurality of bottom fasteners. The first top frame includes four first top rails and a plurality of top fasteners. The second top frame includes four second top rails and the plurality of top fasteners.

Each bottom rail preferably includes a bottom base member, a bottom front member, a first bottom retention member and a second bottom retention member. The bottom front member extends downward from a front edge of the bottom base member. The first bottom retention member extends upward from the front edge of the bottom base member. The second bottom retention member extends upward from the bottom base member and adjacent to the first bottom retention member to form a bottom glazing channel. A first bottom fastener projection extends from an inward surface of the bottom front member, adjacent a top of the bottom front member. A second bottom fastener projection extends from an inward surface of the bottom front member, adjacent a bottom of the bottom front member. A first pair of bottom fastener holes are formed through the bottom base member on each end thereof. A second pair of bottom fastener holes are formed through the bottom front member at one end thereof. Each end of the bottom base member includes a 45 degree chamfer.

Each side rail preferably includes a side base member, a first side fastener projection, a second side fastener projection, a first side retention member, a second side retention member and a side angled member. The side base member is terminated on one end with the first side retention member and terminated on an opposing end with the side angled member. The first side fastener projection extends from an inner surface of the side base member, adjacent the side angled member. The second side fastener projection extends from the inner surface of the side member and from the one end thereof. The second side retention member extends outward from the second side fastener projection to form a side glazing channel relative to the first side retention member.

The first top rail preferably includes a first top base member, a first top front member, a first top flange member and a top double fastener projection. The first top front member extends downward from a bottom surface of the first top base member. One end of an angled extension extends from one end of the first top base member. The first top flange member extends from an opposing end of the angled extension. The double fastener projection extends from an opposing end of the first top base member. The double fastener projection includes a front top plate and a pair of first top fastener projections. The pair of first top fastener projections extend outward from a rear of the top plate. The top plate extends beyond a length of the pair of the first top fastener projections on each end. A pair of first top fastener holes are formed through one end of the top plate. A set of first engagement ribs are formed on an inside surface of the first top front member. A stop lip extends from the inside surface of the first top front member for contact with a top of the second top rail.

The second top rail preferably includes a second top base member, a second top front member, a second engagement member, a second top fastener projection, a first top retention member and a second top retention member. The first top retention member extends downward from a bottom edge of the front member. The second top retention member extends downward from a bottom surface of the second top base member, adjacent the first top retention member to form a top glazing channel. The top front member extends upward from a front edge of the second top base member. The second top fastener projection extends inward from a top of the second top front member. A pair of second top fastener holes are formed through the second top base member on each end thereof. A second side top fastener hole is formed through the second top front member at one end thereof, inline with the second top fastener projection. Each end of the second top base member includes a 45 degree chamfer. The second engagement member extends upward from a top of the second top front member. A set of second engagement ribs are formed on an outside surface of the second engagement member. The first set of engagement ribs mate with the second set of engagement ribs, such that the first top frame does not move vertically relative to the second top frame in a vertical orientation, when the cupola body is assembled.

The bottom frame is assembled by inserting two bottom fasteners through the second pair of bottom fastener holes and screwing the two bottom fasteners into the first and second bottom fastener projections of an adjacent bottom rail. The above process is repeated for the four bottom rails to create the bottom frame. A bottom of the eight side rails are attached to a top of the bottom frame by positioning the side angled members of two side rails against each other in each corner of the bottom frame. Four bottom side fasteners are inserted through the first pair of bottom fastener holes in two adjacent bottom rails and screwed into the first and second side fastener projections of the two adjacent side rails. The above process is repeated for the remaining six side rails to attach the eight side rails to the bottom frame. Four glazing panels are inserted into opposing side glazing channels of two opposing side rails. The glazing panel is also retained by the bottom glazing channel of the four bottom rails.

The second top frame is assembled by inserting one top fastener through the second side top fastener hole of one second top rail and screwing the top fastener into the second top fastener projection of an adjacent second top rail. The above process is repeated for the remaining two second top rails to create the second top frame. A top of the eight side rails are attached to a bottom of the second top frame. Four top side fasteners are inserted through the pair of second top fastener holes in the two adjacent second top rails and screwed into the first and second side fastener projections of the two adjacent side rails. The above process is repeated for the remaining six side rails to attach the eight side rails to the second top frame frame. Four glazing panels are received by a top glazing channel.

The first top frame is assembled to the second top frame by inserting two first side top fasteners through a pair of first top fastener holes and screwing the pair of first side top fasteners into the pair of first top fastener projections of an adjacent first top rail. The above process is repeated for the remaining top rail. The three top rails are then push over two opposed second top rails at the correct height. The fourth first top rail is then assembled to the three first top rails as previously discussed to properly engage the first top frame with the second top frame. Finally, a cupola roof is attached to the first top frame. The cupola roof includes four triangular panels, a top cap and a fastening plate. Bottom clips of the four triangular panels are secured to the four first top flange members of the first top frame. The cupola roof is completed by joining the top cap to the fastening plate with a plurality of fasteners to retain top flanges on the four triangular panels.

Accordingly, it is an object of the present invention to provide a cupola body fabricated from extrusions, which utilizes extruded aluminum rails fastened to each other to create a cupola body that is more rigid than that the prior art.

It is another object of the present invention to provide a cupola body fabricated from extrusions, which utilizes extruded aluminum rails fastened to each other to create a cupola body that may be easily assembled to different sizes.

Finally, it is an additional object of the present invention to provide a cupola body fabricated from extrusions, which utilizes extruded aluminum rails fastened to each other to create a cupola body that allows for quick installation of a cupola cover.

These and additional objects, advantages, features and benefits of the present invention will become apparent from the following specification.

FIG. **9*a*** is a top perspective view of two second top rails attached to a top of two side rails of a cupola body in accordance with the present invention.

Figure 10:
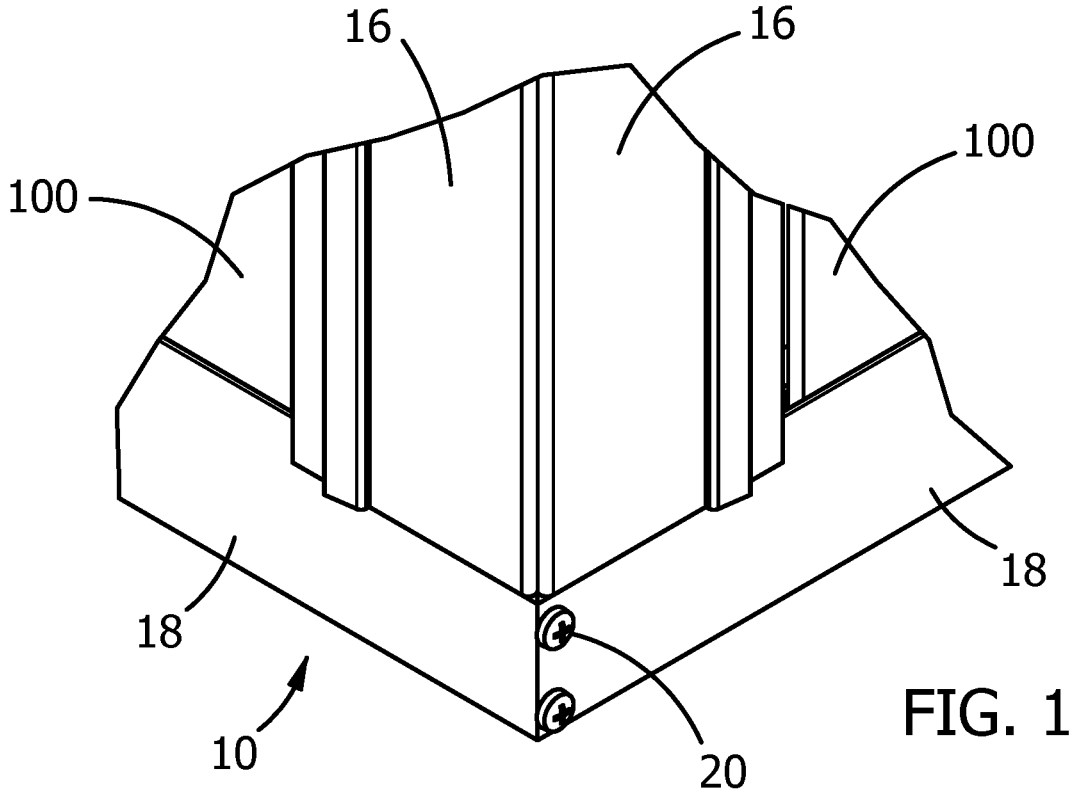

FIG. 10 is a perspective view of a bottom of two side rails attached to a top of two bottom rails of a cupola body in accordance with the present invention.

FIG. **10*a*** is a bottom perspective view of a bottom of two side rails attached to a top of two bottom rails of a cupola body in accordance with the present invention.

Figure 11:
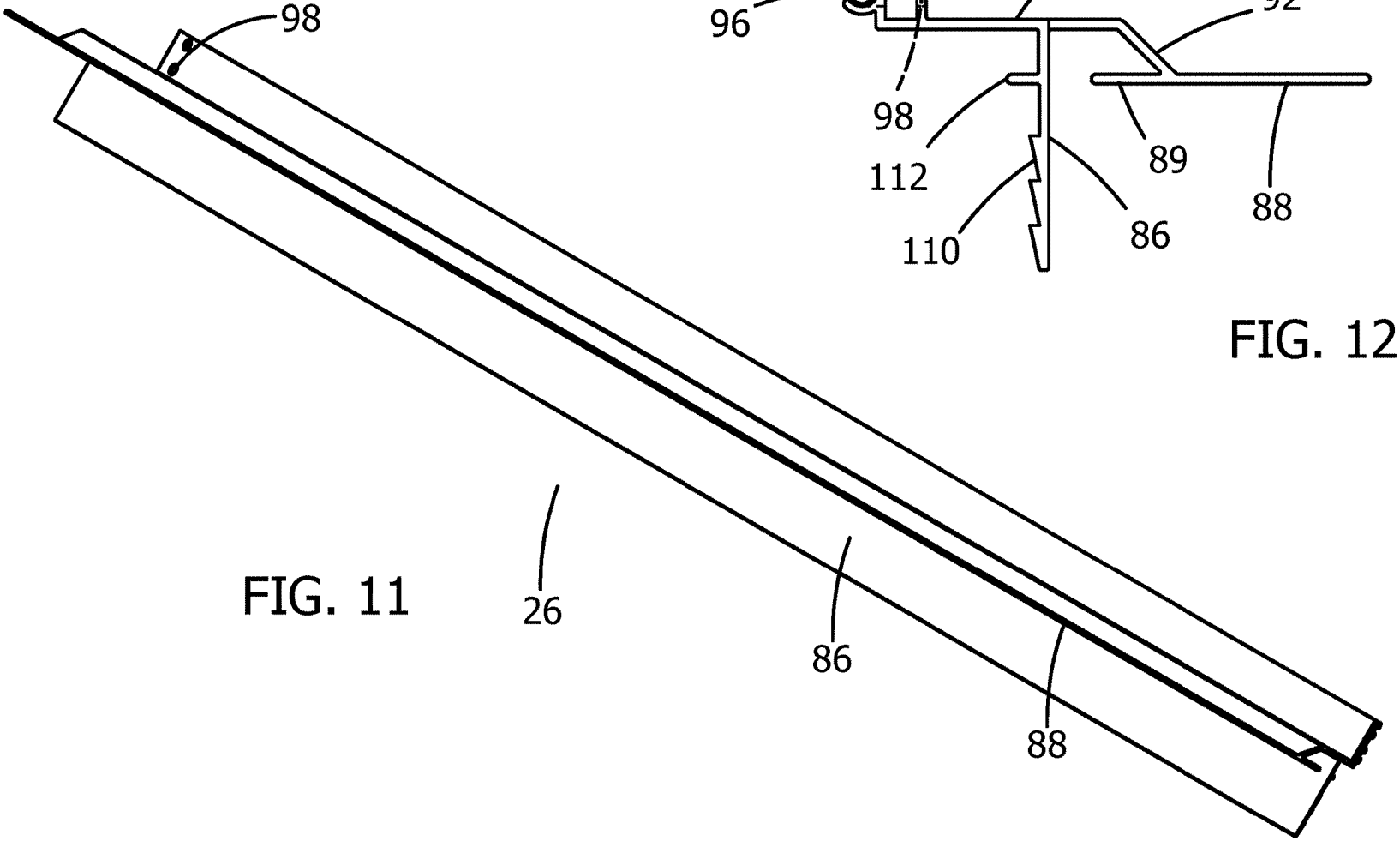

FIG. 11 is a front perspective view of a first top rail of a cupola body in accordance with the present invention.

Figure 12:
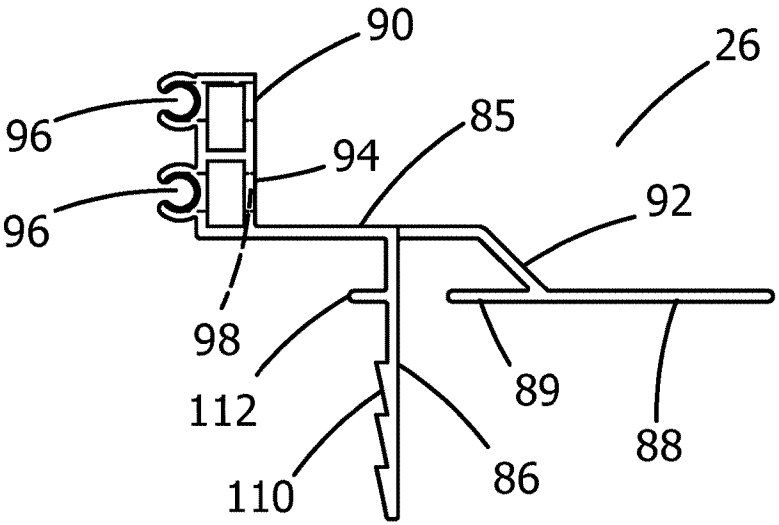

FIG. 12 is an end view of a first top rail of a cupola body in accordance with the present invention.

Figure 13:
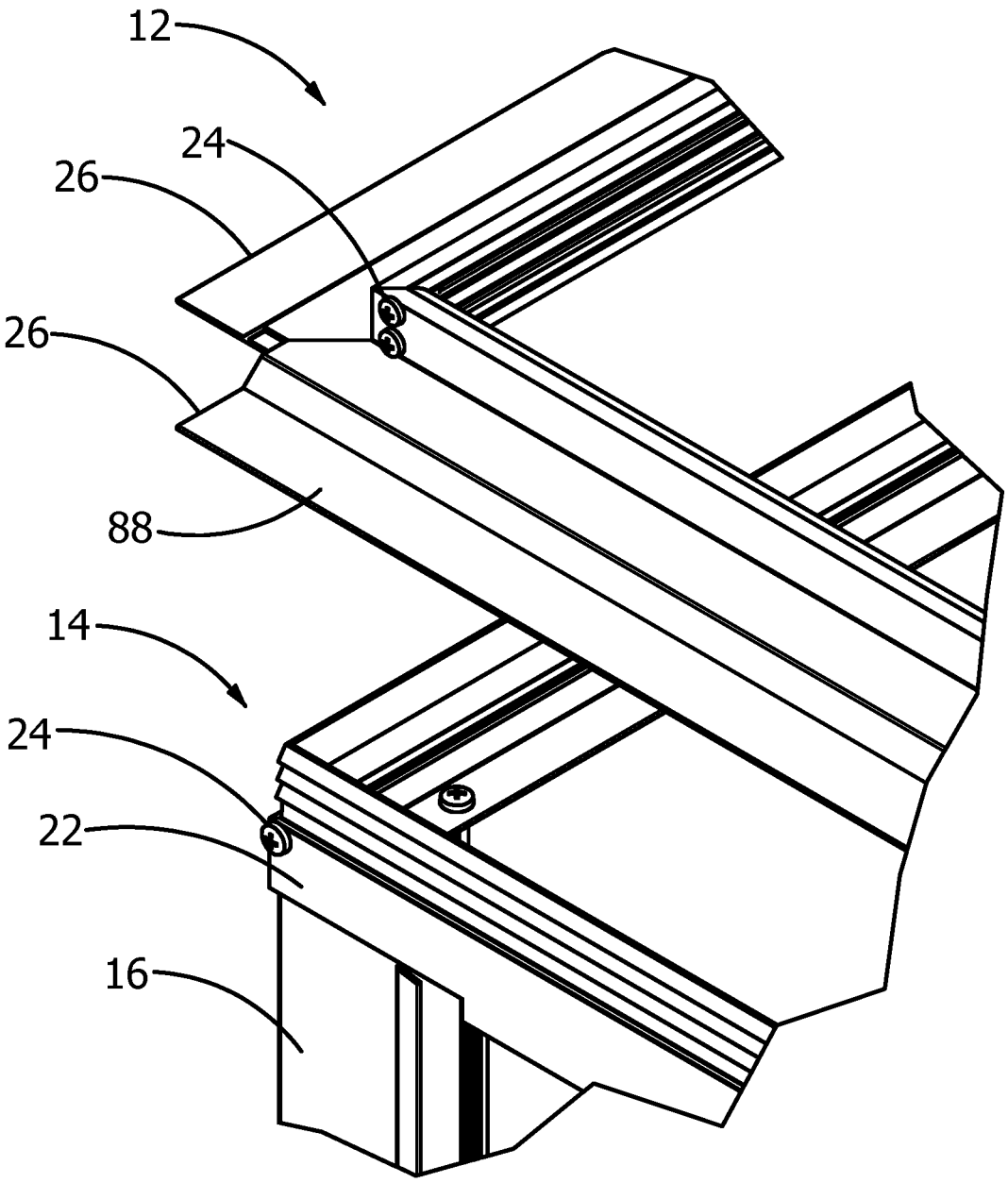

FIG. 13 is a partially exploded perspective view of a portion of a first top frame relative to a portion of a second top frame of a cupola body in accordance with the present invention.

Figure 14:
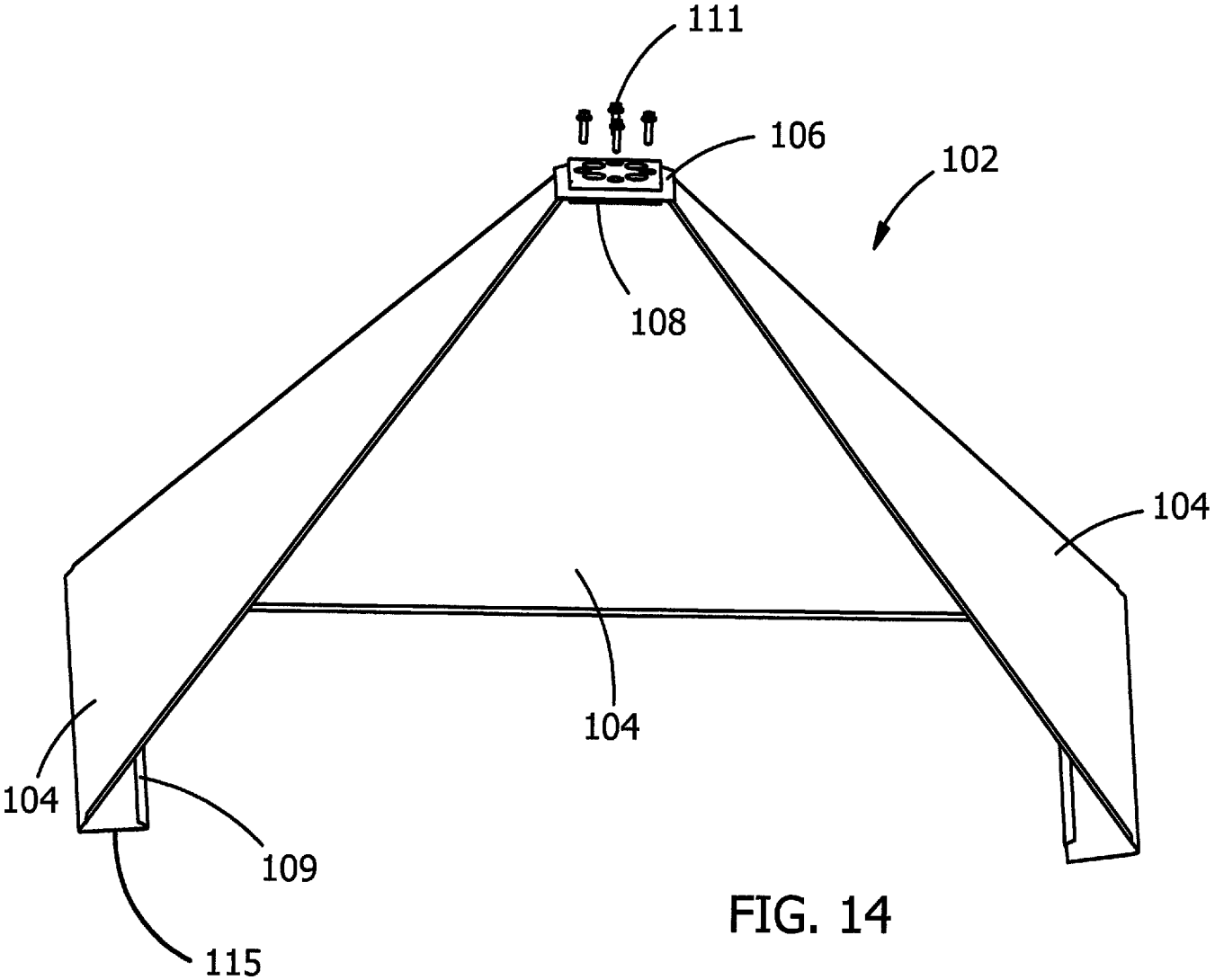

FIG. 14 is a perspective view of a portion of a cupola roof, which is attached to a top of a cupola body in accordance with the present invention.

DETAILED DESCRIPTION OF THE PREFERRED EMBODIMENTS

Figure 1:
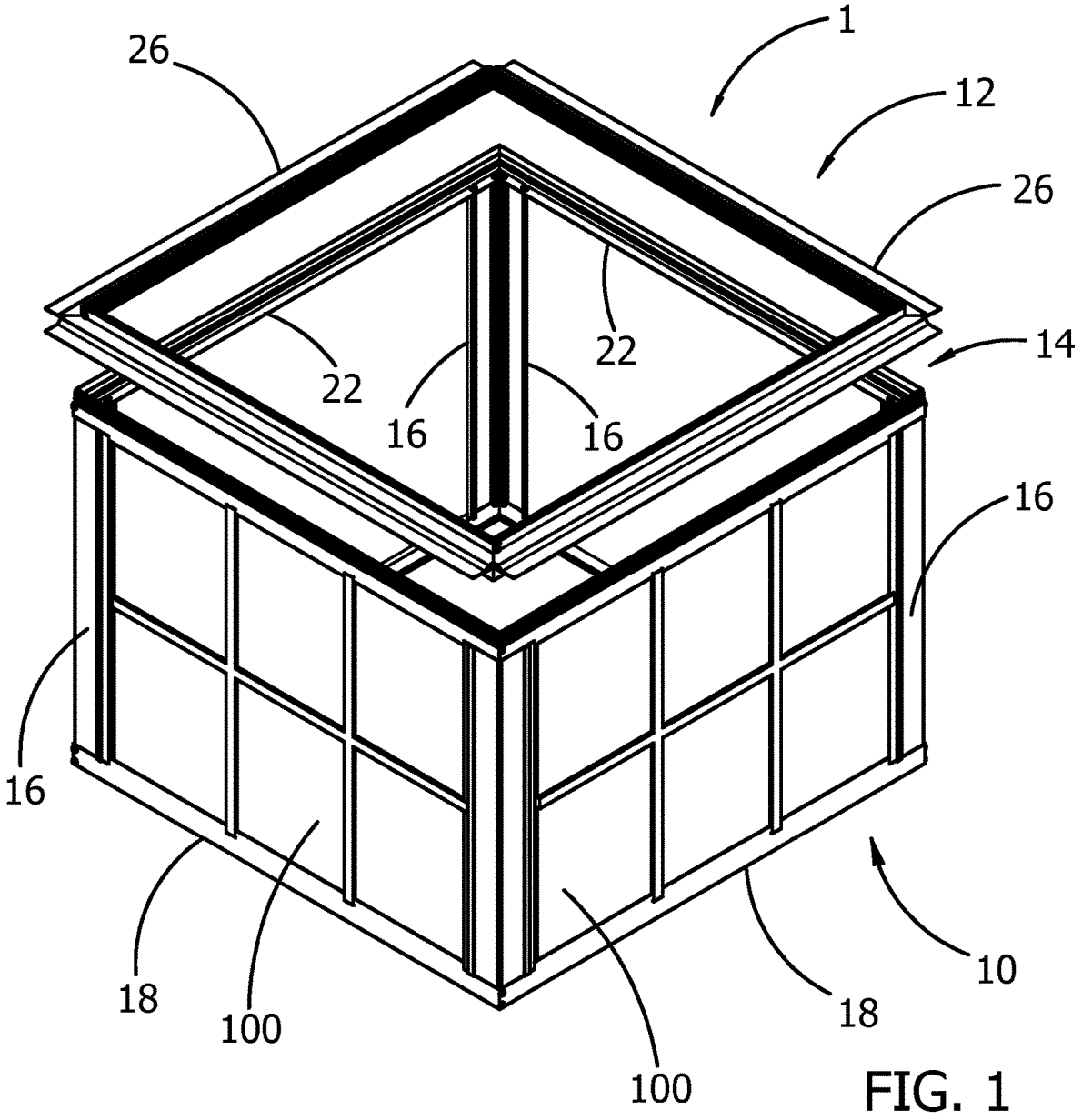
FIG. 1 is a partially exploded perspective view of a cupola body in accordance with the present invention.
Figure 2:
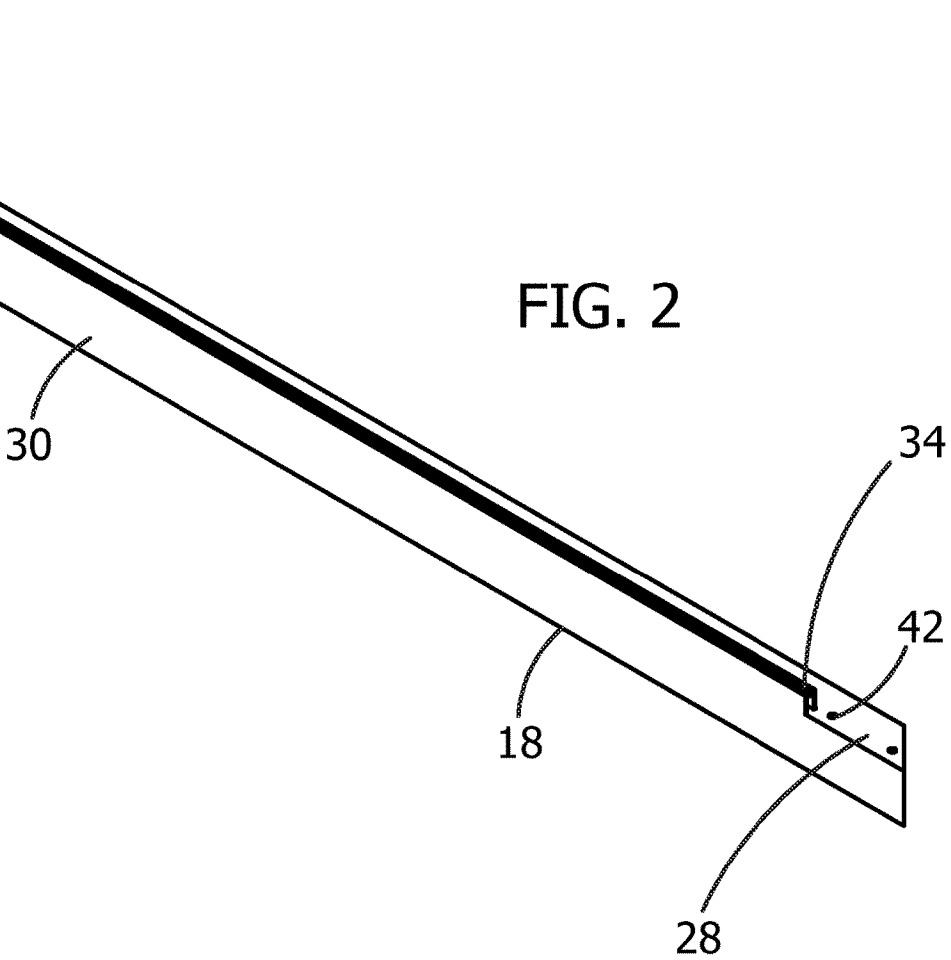
FIG. 2 is a perspective view of a bottom rail of a cupola body in accordance with the present invention.
Figure 3:
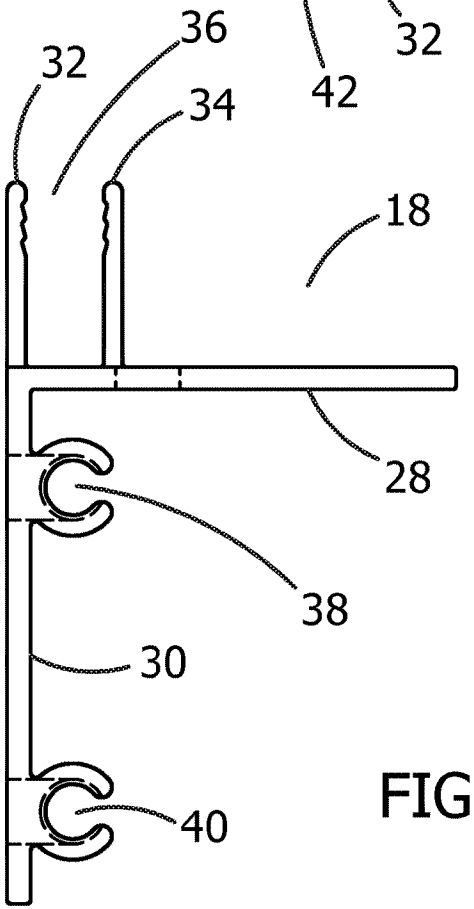
FIG. 3 is an end view of a bottom rail of a cupola body in accordance with the present invention.

With reference now to the drawings, and particularly to FIG. 1, there is shown a partially exploded perspective view of a cupola body 1. With reference to FIGS. 2-12, the cupola body 1 preferably includes a bottom frame 10, a first top frame 12, a second top frame 14 and eight side rails 16. The bottom frame 10 includes four bottom rails 18 and eight bottom fasteners 20. The second top frame 14 includes four second top rails 22 and four top fasteners 24. The first top frame 12 includes four first top rails 26 and the eight top fasteners 24. The cupola body 1 is shown as a cube with six faces. However, the shape of the cupola body 1 may be rectangular, such that the lengths of some of the faces are not equal to each other. With reference to FIGS. 2-3, each bottom rail 18 preferably includes a bottom base member 28, a bottom front member 30, a first bottom retention member 32 and a second bottom retention member 34. The bottom front member 30 extends downward from a front edge of the bottom base member 28. The first bottom retention member 32 extends upward from the front edge of the bottom base member 30. The second bottom retention member 34 extends upward from the bottom base member 28 and adjacent the first bottom retention member 32 to form a bottom glazing channel 36. A first bottom fastener projection 38 extends from an inward surface of the bottom front member 30, adjacent a top of the bottom front member 30. A second bottom fastener projection 40 extends from an inward surface of the bottom front member 30, adjacent a bottom of the bottom front member 30. A first pair of bottom fastener holes 42 are formed through the bottom base member on each end thereof. A second pair of bottom fastener holes 44 are formed through the bottom front member 30 at one end thereof. A 45 degree chamfer 46 is formed on each end of the bottom base member 18.

Figure 4:
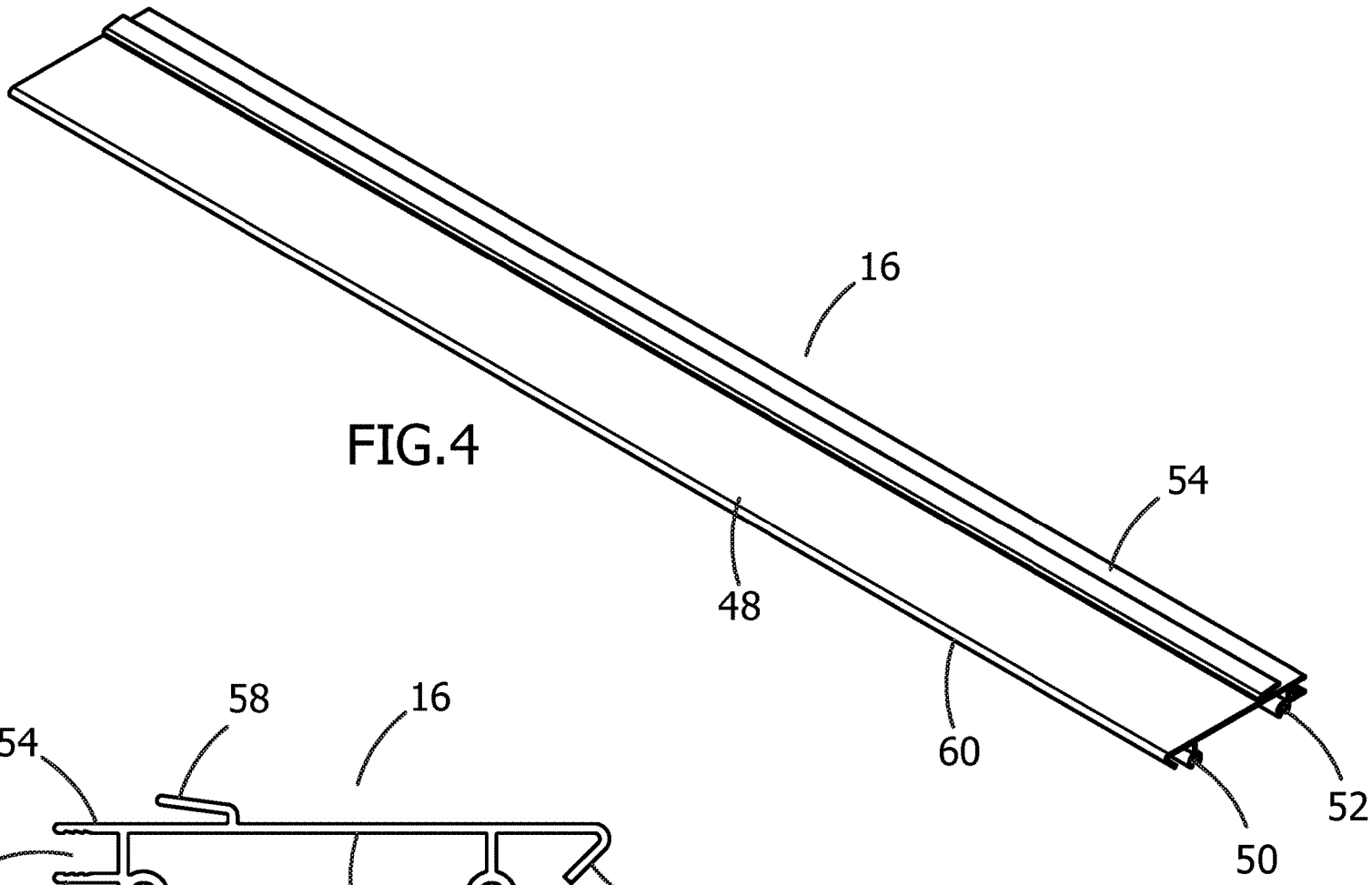
FIG. 4 is a perspective view of a side rail of a cupola body in accordance with the present invention.
Figure 5:
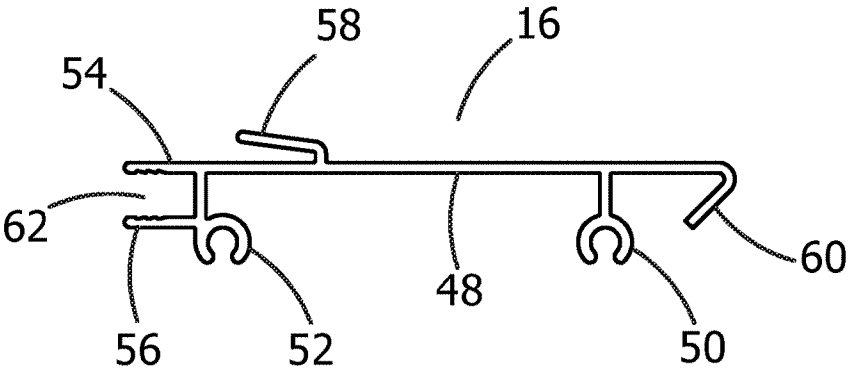
FIG. 5 is an end view of a side rail of a cupola body in accordance with the present invention.

With reference to FIGS. 4-5, each side rail 16 preferably includes a side base member 48, a first side fastener projection 50, a second side fastener projection 52, a first side retention member 54, a second side retention member 56, a side clip projection 58 and a side angled member 60. The side base member 48 is terminated on one end with the first side retention member 54 and terminated on an opposing end with the side angled member 60. The first side fastener projection 50 extends from an inner surface of the side base member 48, adjacent the side angled member 60. The second side fastener projection 52 extends from the inner surface of the side base member 48 and at the one end thereof. The second side retention member 56 extends outward from the second side fastener projection 52 to form a side glazing channel 62 relative to the first side retention member 50. The side clip projection 58 extends from an outer surface of the side base member 48, adjacent the second fastener projection 52. The side clip projection 58 is used to retain a trim piece (not shown).

Figures 7, 8:
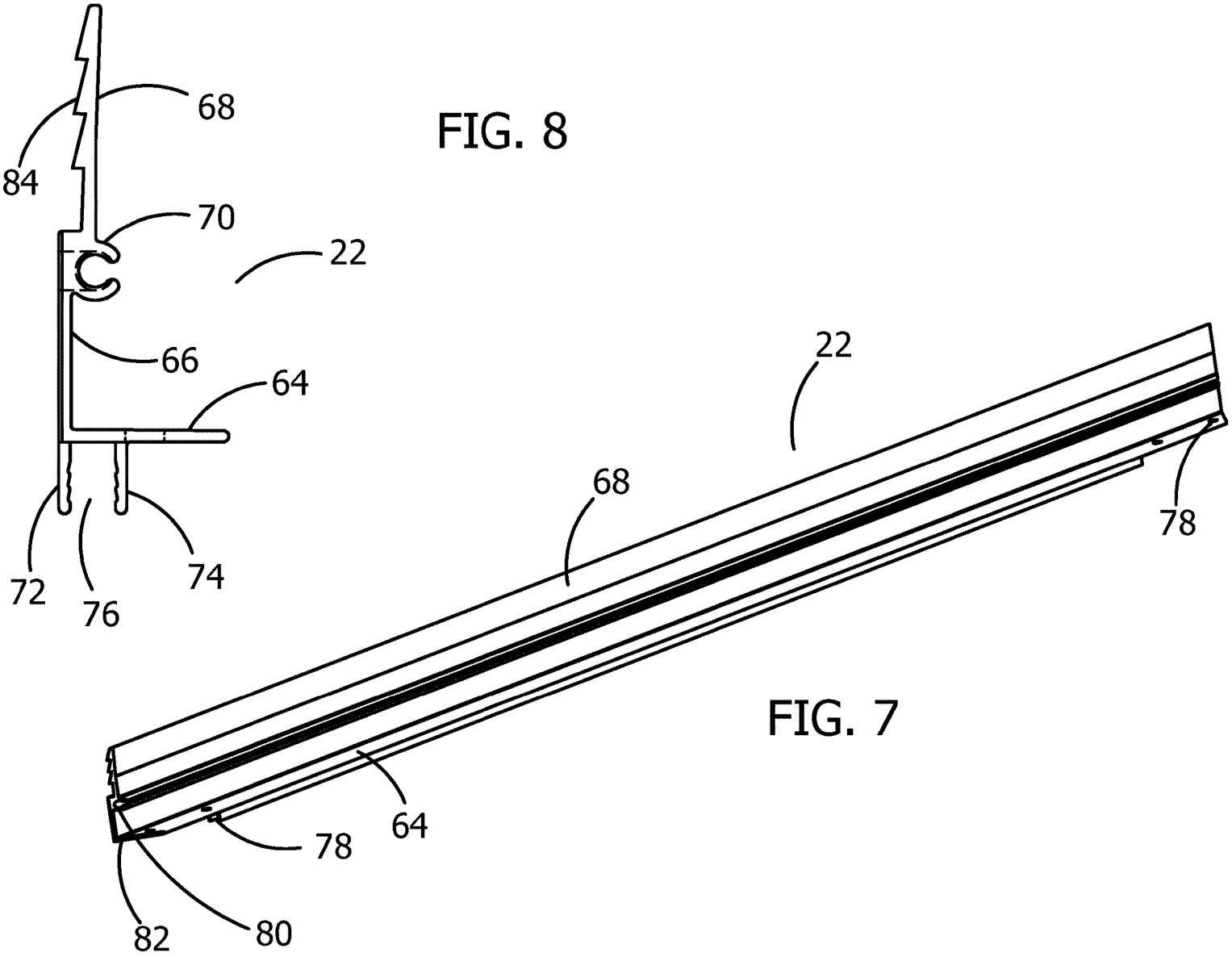
FIG. 7 is a perspective view of a second top rail of a cupola body in accordance with the present invention.
FIG. 8 is an end view of a second top rail of a cupola body in accordance with the present invention.

With reference to FIGS. 7-8, the second top rail 22 preferably includes a second top base member 64, a second top front member 66, a second engagement member 68, a second top fastener projection 70, a first top retention member 72 and a second top retention member 74. The first top retention member 72 extends downward from a bottom edge of the front member 66. The second top retention member 74 extends downward from a bottom surface of the second top base member 64, adjacent the first top retention member 72 to form a top glazing channel 76. The second top fastener projection 70 extends inward from a top of the second top front member 66. A pair of second top fastener holes 78 are formed through the second top base member 64 on each end thereof. A second end top fastener hole 80 is formed through the second top front member 66 at one end thereof, inline with the second top fastener projection 70. Each end of the second top base member includes a 45 degree chamfer 82. The second engagement member 68 extends upward from a top of the second top front member 66. A set of second engagement ribs 84 are formed on an outside surface of the second engagement member 68.

With reference to FIGS. 9, 9*a* and 11-12, the first top rail 26 preferably includes a first top base member 85, a first top front member 86, a first top flange member 88 and a top double fastener projection 90. The first top front member 86 extends downward from a bottom surface of the first top base member 84. One end of an angled extension 92 extends from one end of the first top base member 84. The first top flange member 88 extends from an opposing end of the angled extension 92, such that a clip portion 89 of the first top flange member 88 extends inward from the angled extension 92. The double fastener projection 90 extends from an opposing end of the first top base member 84. The double fastener projection 90 includes a top plate 94 and a pair of first top fastener projections 96. The pair of first top fastener projections 96 extend outward from a front of the top plate 94. The top plate 94 extends beyond a length of the pair of the first top fastener projections 96 on each end. A pair of first top fastener holes 98 are formed through one end of the top plate 94. A set of first engagement ribs 110 are formed on an inside surface of the first top front member 86. A stop lip 112 extends from the inside surface of the first top front member 86 for contact with a top of the second top rail 22. The first set of engagement ribs 110 mate with the second set of engagement ribs 84, such that the first top frame 12 does not move vertically relative to the second top frame 14 in a vertical orientation, when the cupola body 1 is assembled. However, the first and second top rails could be combined into a single top rail.

Figure 6:
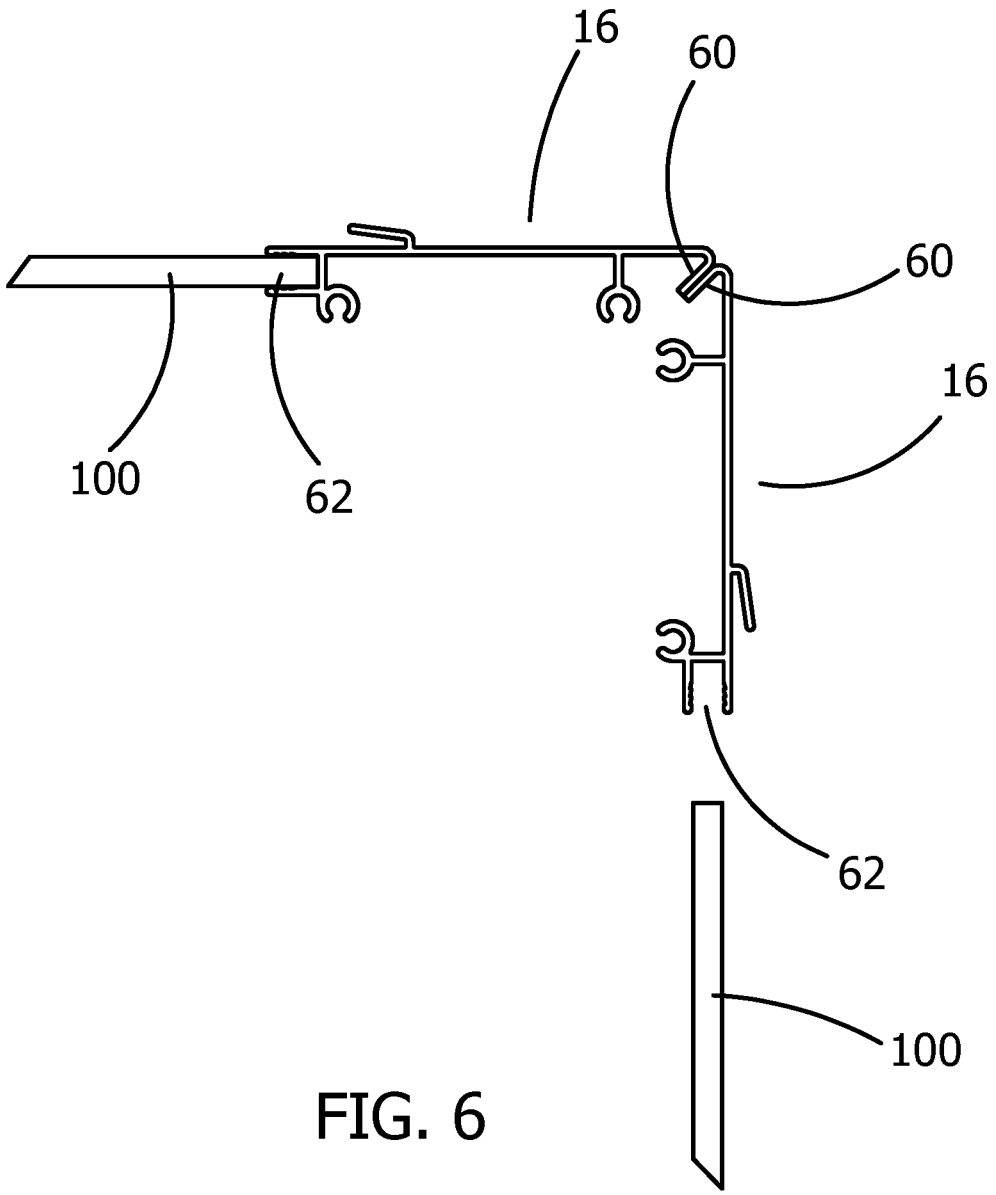
FIG. 6 is a partially exploded top view of two side rails adjacent to each other and two glazing panels of a cupola body in accordance with the present invention.
Figure 10A:
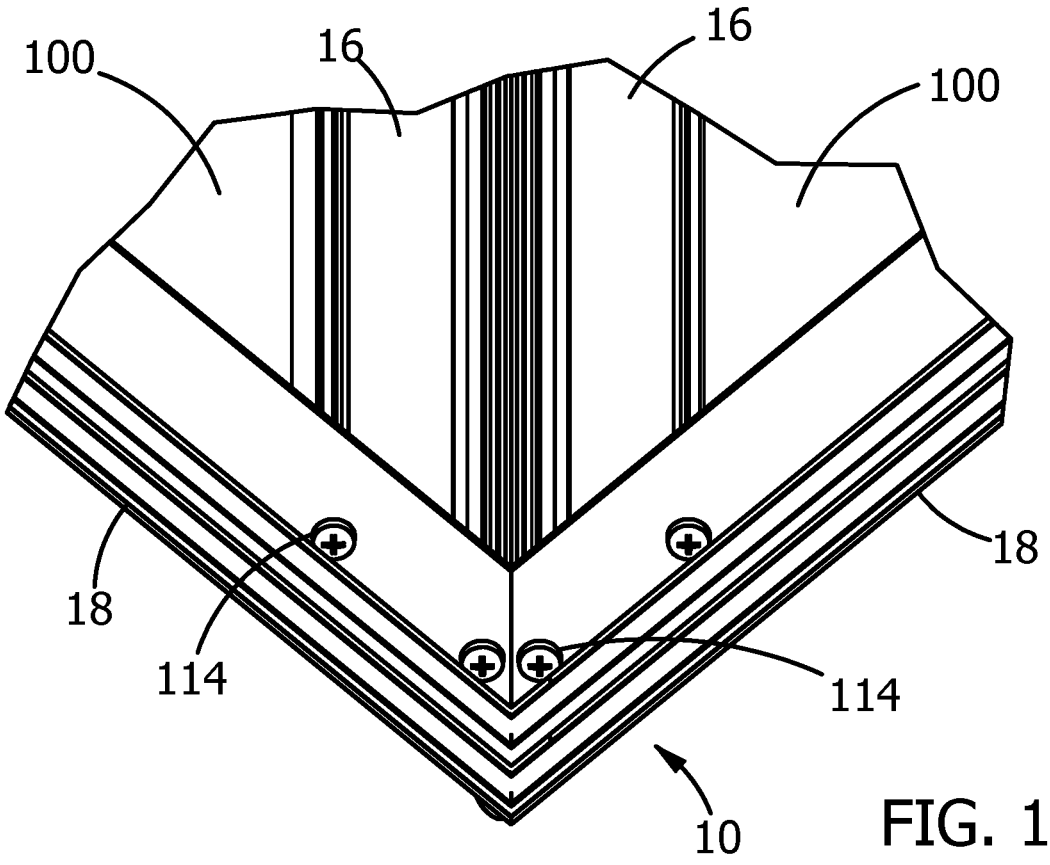

With reference to FIGS. 10-10*a*, the bottom frame 10 is assembled by inserting the two bottom fasteners 20 through the second pair of bottom fastener holes 44 of one bottom rail 18 and screwing the two bottom fasteners 20 into the first and second bottom fastener projections 38, 40 of an adjacent bottom rail 18. The above process is repeated for the remaining two bottom rails 18 to create the bottom frame 10. With reference to FIGS. 6 and 10, a bottom of the eight side rails 16 are attached to a top of the bottom frame 10 by positioning the side angled members 60 of two side rails 16 against each other in each corner of the bottom frame 10. Four bottom side fasteners 114 are inserted through the first pair of bottom fastener holes 42 in two adjacent bottom rails 18 and screwed into the first and second side fastener projections 50, 52 of the two adjacent side rails 18. The above process is repeated for the six remaining side rails 16 to attach the eight side rails 16 to the bottom frame 10. With reference to FIG. 6, four glazing panels 100 are inserted into opposing side glazing channels 62 of two opposing side rails 16. The glazing panel 100 is also retained by the bottom glazing channel 36 of the bottom rail 18. However, two side rails 16 could be combined into a single side rail.

Figure 9:
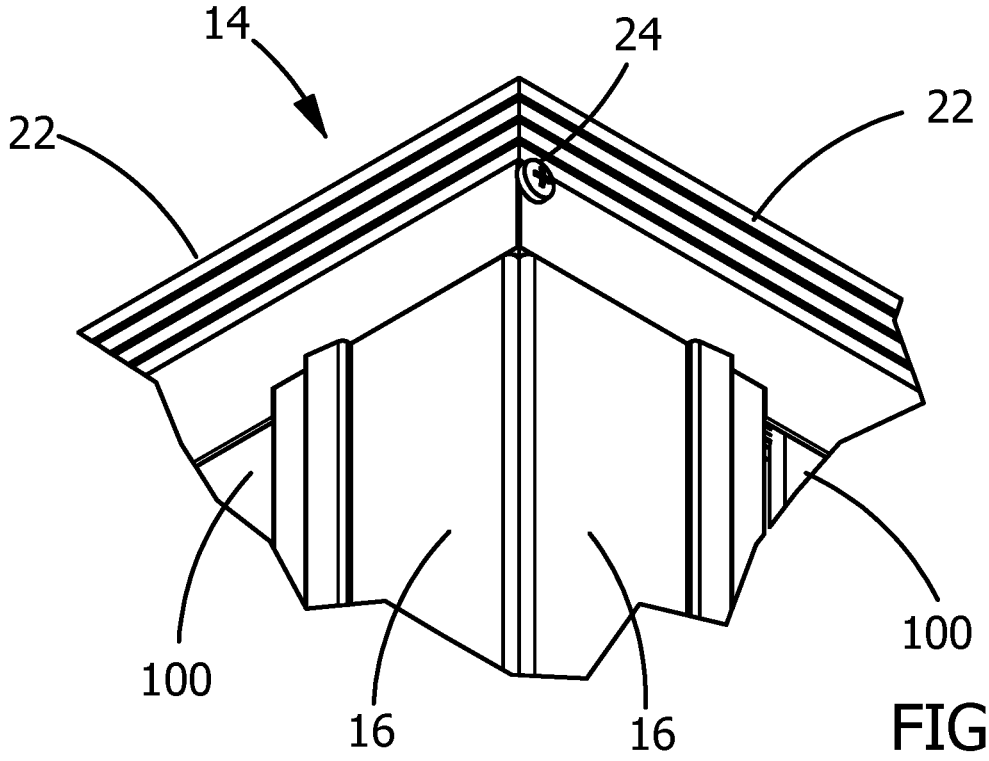
FIG. 9 is a perspective view of two second top rails attached to a top of two side rails of a cupola body in accordance with the present invention.
Figure 9A:
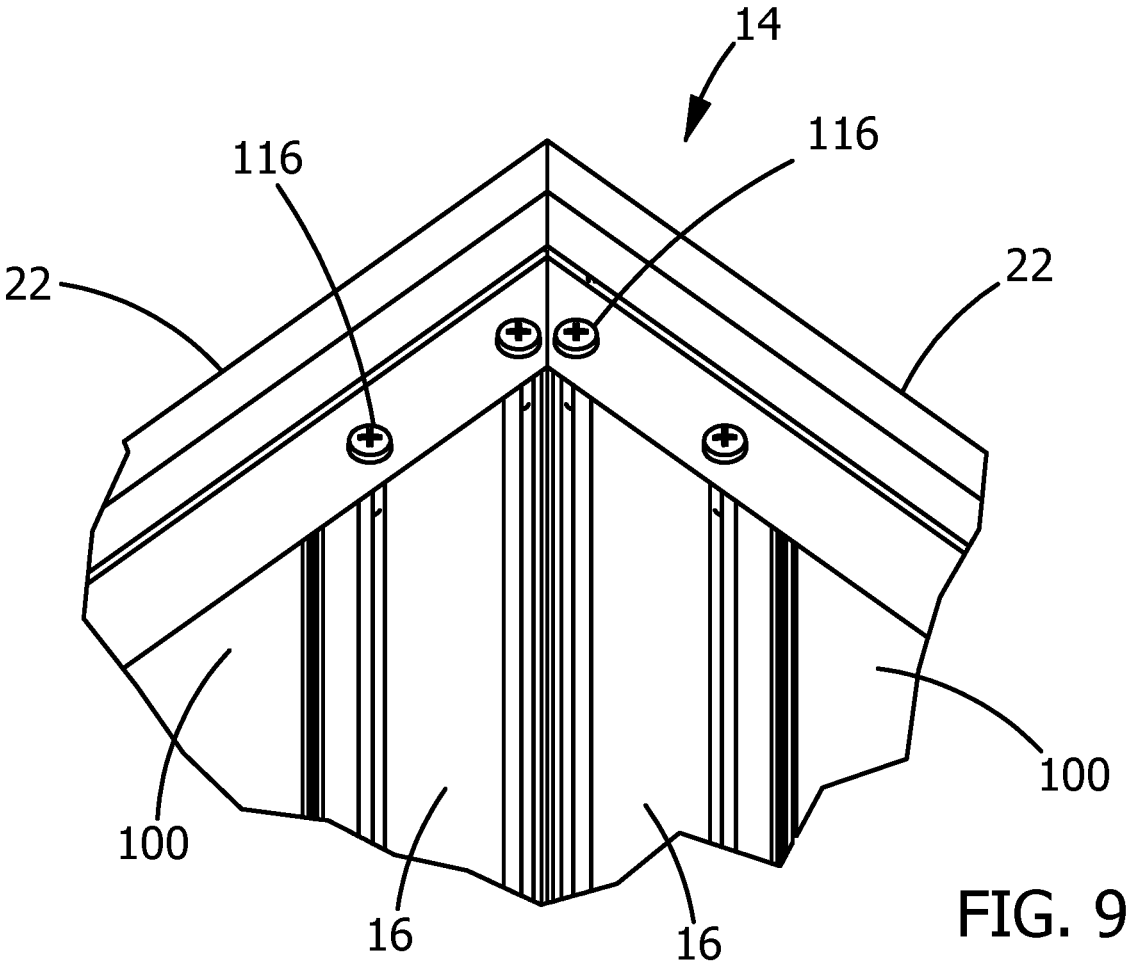

With reference to FIGS. 9-9*a*, the second top frame 14 is assembled by inserting one top fastener 24 through the second end fastener hole 80 of one second top rail 22 and screwing the top fastener 24 into the second top fastener projection 70 of an adjacent second top rail 22. The above process is repeated for the two remaining second top rails 22 to create the second top frame 14. With reference to FIG. 9, a top of the eight side rails 16 are attached to a bottom of the second top frame 14. Four top side fasteners 116 are inserted through the pair of second top fastener holes 78 in the two adjacent second top rails 22 and screwed into the first and second side fastener projections 50, 52 of the two adjacent side rails 16. The above process is repeated for the remaining six side rails 16 to attach the eight side rails 16 to the second top frame 14. Four glazing panels 100 are received by a top glazing channel 76.

With reference to FIG. 13, the first top frame 12 is assembled to the second top frame 14 by inserting two top fasteners 24 through a pair of first top fastener holes 98 and screwing the pair of top fasteners 24 into the pair of first top fastener projections 96 of an adjacent first top rail 26. The above process is repeated for the remaining two top rails 26. The assembled first top frame is then pushed over the second top frame, until the four stop lips 112 contact a top of the four second engagement members 68. Finally, a cupola roof 102 is attached to the first top frame 12. The cupola roof 102 includes four triangular panels 104, a top cap 106 and a fastening plate 108. Four cupola flanges 115 extend inward from a bottom of the four triangular panels 104. Four bottom clips 109 terminate ends of the four triangular panels 104. The four bottom clips 109 are secured to the four clip portions 89 of the first top frame 12. The four cupola flanges 115 contact a bottom of the four first top flange members 88 of the first top frame 12. The cupola roof 102 is completed by joining the top cap 106 to the fastening plate 108 with a plurality of fasteners 111 to retain top flanges of the four triangular panels 104.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A cupola body fabricated from extrusions, comprising: four side rails;

a bottom frame includes four bottom rails, a bottom of said four side rails are attached to a top of said bottom frame; and a top frame includes four top rails, a top of said four side rails are attached to a bottom of said top frame, a plurality of horizontal outer ribs are formed on an outer surface of said top frame, each one of said plurality of horizontal outer ribs includes an outer sloped surface and an outer retention surface to form an outer saw tooth pattern; and a cupola roof includes four cupola rails, a plurality of horizontal inner ribs are formed on an inside surface of said four cupola rails, each one of said plurality of horizontal inner ribs includes an inner sloped surface and an inner retention surface to form an inner saw tooth pattern, wherein said cupola roof is pushed on to said top frame, said plurality of inner retention surfaces engage said plurality of outer retention surfaces and retain said cupola roof relative to said cupola body.

2. The cupola body fabricated from extrusions of claim 1 wherein:

each one said four bottom rails includes a bottom base member, a bottom front member, and a pair of fastener projections, said bottom front member extends downward from a front edge of said bottom base member, said pair of fasteners projections extend from an ear of said bottom front member.

3. A cupola body fabricated from extrusions, comprising: four side rails;

a bottom frame includes four bottom rails, a bottom of said four side rails are attached to a top of said bottom frame; and a first top frame includes four first top rails, each one of said four first top rails includes a first top flange member, said top flange member extends outward from each one of said four first top rails, a clip portion extends behind said first top flange member, said first top flange member is coplanar with said clip portion, a cupola roof includes four inward facing flanges, said four inward facing flanges are terminated with four bottom clips, wherein one of said four bottom clips engages said clip portion; and a second top frame includes four second top rails, a top of said four side rails are attached to a bottom of said second top frame, wherein said first top frame is engaged with said second top frame.

4. The cupola body fabricated from extrusions of claim 3 wherein:

each one said four bottom rails includes a bottom base member, a bottom front member, and a pair of fastener projections, said bottom front member extends downward from a front edge of said bottom base member, said pair of fasteners projections extend from an ear of said bottom front member.

5. The cupola body fabricated from extrusions of claim 3 wherein:

each one of said four first top rails includes a first top base member, a first top front member and said first top flange member, said first top front member extends downward from said top base member, said first top flange member extends outward from said first top base member.

6. A cupola body fabricated from extrusions, comprising:

eight side rails are disposed on an outside surface of said cupola body, an inward facing side clip projection extends from an outside surface of each one of said eight side rails, wherein a trim piece is retained between two opposing side clip projections of two of said eight side rails, a side angle member extends inward at an oblique angle from an end opposing said inward facing side clip, side angled members of two adjacent side rails are located next to each other to form a corner;

a bottom frame includes four bottom rails, a bottom of said eight side rails are attached to a top of said bottom frame;

a first top frame includes four first top frame rails; and a second top frame includes four second top frame rails, a top of said eight side rails are attached to a bottom of said top frame, said first top frame is engaged with said second top frame.

7. The cupola body fabricated from extrusions of claim 6 wherein:

each one of said four bottom rails includes a bottom glazing channel for receiving a glazing panel, each one of said four second top rails includes a top glazing channel for receiving the glazing panel.

8. The cupola body fabricated from extrusions of claim 6 wherein:

each one of said eight side rails includes a side glazing channel for receiving a glazing panel.

9. The cupola body fabricated from extrusions of claim 6 wherein:

each one said four bottom rails includes a bottom base member, a bottom front member, and a pair of fastener projections, said bottom front member extends downward from a front edge of said bottom base member, said pair of fasteners projections extend from an ear of said bottom front member.

10. The cupola body fabricated from extrusions of claim 6 wherein:

each one of said eight side rails includes a side base member, said side angled member, a first fastener projection and a second fastener projection, said first fastener projection is located adjacent said side angled member, said second fastener projection is located on an opposing edge of said side base member.

11. The cupola body fabricated from extrusions of claim 6 wherein:

said first top frame is capable of retaining a cupola roof.

12. The cupola body fabricated from extrusions of claim 6 wherein:

each one said first top frame rails includes a first top base member, a first top front member, said first top flange member and a pair of fastener projections, said first top front member extends downward from said top base member, said first top flange member extends outward from one end of said first top base member, said pair of fastener projections extend from an opposing end of said first top base member.

13. The cupola body fabricated from extrusions of claim 12, further comprising:

a first set of engagement ribs are formed on a rear of said first top front member.

14. The cupola body fabricated from extrusions of claim 6 wherein:

each one said second top frame rails includes a second top base member, a second top front member and a second fastener projection, said second top front member extends upward from said top base member, said second fastener projection is located on a top edge of said second top front member.

15. The cupola body fabricated from extrusions of claim 14, further comprising:

a second engagement member extends upward from said second fastener projection, said second engagement member includes a set of second engagement ribs.

* * * * *